US007926558B2

(12) United States Patent
Hagberg

(10) Patent No.: US 7,926,558 B2
(45) Date of Patent: Apr. 19, 2011

(54) COOLER DEVICE

(75) Inventor: Magnus Hagberg, Södertälje (SE)

(73) Assignee: Scania CV AB (SE)

( * ) Notice: Subject to any disclaimer, the term of this patent is extended or adjusted under 35 U.S.C. 154(b) by 814 days.

(21) Appl. No.: 11/813,508

(22) PCT Filed: Mar. 9, 2006

(86) PCT No.: PCT/SE2006/000302

§ 371 (c)(1),
(2), (4) Date: Aug. 28, 2007

(87) PCT Pub. No.: WO2006/098677

PCT Pub. Date: Sep. 21, 2006

(65) Prior Publication Data

US 2008/0115917 A1 May 22, 2008

(30) Foreign Application Priority Data

Mar. 15, 2005 (SE) ..... 0500592

(51) Int. Cl.
*F28F 9/22* (2006.01)

(52) U.S. Cl. ..... 165/174; 165/145

(58) Field of Classification Search ..... 165/145, 165/174, 176

See application file for complete search history.

(56) References Cited

U.S. PATENT DOCUMENTS

| | | | |
|---|---|---|---|
| 1,895,891 | A | 1/1933 | Modine |
| 3,908,758 | A | 9/1975 | Armonies et al. |
| 5,649,588 | A | 7/1997 | Lee |
| 2003/0006028 | A1 | 1/2003 | Kalbacher |

FOREIGN PATENT DOCUMENTS

| | | |
|---|---|---|
| DE | 1909128 | 9/1970 |
| DE | 3511952 | 10/1986 |
| FR | 2385069 | 10/1978 |
| GB | 1414908 | 11/1975 |
| JP | 2003-065696 | 3/2003 |
| JP | 2005-127630 | 5/2005 |

OTHER PUBLICATIONS

International Search Report PCT/SE2006/000302 dated Jun. 9, 2006.

*Primary Examiner* — Teresa J Walberg
(74) *Attorney, Agent, or Firm* — Ostrolenk Faber LLP

(57) ABSTRACT

A cooler device comprising a cooling portion with at least one tubular element which has an internal flow duct for guiding a first medium between a first and a second tank. A second cooling medium in contact with an outside surface of the tubular element cools the first medium as it is led through the flow duct. A first tank receives the first medium before it is led into the cooling portion. The first tank has an outside surface provided with protruding material portions which produce an enlarged contact surface with the cooling second medium so that the first medium is subjected to a first step of cooling within the first tank.

8 Claims, 2 Drawing Sheets

COOLER DEVICE

CROSS REFERENCE TO RELATED APPLICATION

The present application is a 35 U.S.C. §§371 national phase conversion of PCT/SE2006/000302, filed 9 Mar. 2006, which claims priority of Swedish Application No. 0500592-1, filed 15 Mar. 2005. The PCT International Application was published in the English language.

BACKGROUND TO THE INVENTION, AND THE STATE OF THE ART

The present invention relates to a cooler device and particularly to initial cooling of a medium before it enters a cooling portion of the cooler. The invention has application to combustion engines.

A conventional radiator of a vehicle is usually provided with a cooling portion in which the radiator liquid is cooled and two gathering tanks which are connected to the cooling portion at opposite ends. The purpose of the first gathering tank is to receive the warm radiator liquid before it is led into the cooling portion. The purpose of the second gathering tank is to receive the radiator liquid after it has passed through the cooling portion. The cooling portion usually comprises a plurality of tubular elements arranged in parallel which lead the radiator liquid between the gathering tanks. Surrounding air flows in the spaces between the tubular elements so that the radiator liquid is subjected to cooling within the tubular elements. Heat transfer elements of various kinds, e.g. in the form of thin folded metal elements, are usually arranged in the spaces between the tubular elements to provide an increased contact surface with the air which flows in the spaces between the tubular elements. The tubular elements and the heat-transferring elements may be made of metals such as aluminum, copper, brass and magnesium or other materials which have very good heat-conducting characteristics. Conventional gathering tanks are usually made of injection-moulded plastic material.

US 2003/0006028 refers to a heat exchanger which can be used as an air-cooled radiator of a vehicle. The heat exchanger comprises a cooling portion with a plurality of tubular elements which are intended to lead a radiator liquid between two gathering tanks. The invention there described relates to the configuration of the connection between the gathering tanks and the cooling portion. The gathering tanks are there made of an injection-moulded plastic material. The specification states that the gathering tanks may alternatively be made of aluminum or other suitable material.

SUMMARY OF THE INVENTION

The object of the present invention is to provide a cooler device which is of compact construction and provides very effective cooling of a warm medium which is led through the cooler device.

This object is achieved with the cooler device of the invention. Cooling of a first medium is accomplished inside tubular elements over which a second medium passes to cool the first medium in the tubular elements. A first tank delivers first medium to the tubular elements and a second tank receives the cooled first medium from the tubular elements. The first tank is here provided with an outside surface which has protruding material portions in contact with the cooling second medium. The protruding material portions result in the first tank providing a relatively large external contact surface with the cooling second medium. The first medium is at its warmest when it is led into the first tank. The relatively large contact surface thus created between the first tank and the cooling second medium and the large temperature difference between the warm first medium and the cold second medium result in the warm first medium being already subjected to good cooling in the first tank. The warm first medium is thus provided with a first step of cooling within the first tank before it is led to the cooling portion where it undergoes its residual cooling. As the first medium is thus also subjected to cooling in the first tank, the cooler device has a larger cooling capacity than a conventional radiator in which cooling substantially takes place only in the cooling portion. The cooler device can therefore cool a warm first medium to a lower temperature than a conventional radiator of comparable size. The cooler device can therefore be provided with a cooling portion which is smaller than the cooling portion of a conventional radiator with the same cooling capacity. The cooler device thus occupies less space than a conventional radiator with a comparable cooling capacity.

According to a preferred embodiment of the present invention, the first tank comprises a flow element adapted to leading the first medium towards an inside surface of the first tank, which inside surface is situated close to an outside surface which is in contact with the cooling second medium. The warm first medium is thus subjected to effective cooling by the cooling second medium within the first tank. With advantage, said flow element defines a flow path in which the first medium is in contact with an inside surface of the first tank. With suitable configuration of such a flowpath, very effective cooling of the first medium can take place in the first tank.

According to another preferred embodiment of the present invention, the first tank and said protruding material portions are made of material which has good heat-conducting characteristics. With advantage, they are made of the same material. To provide effective cooling of the warm first medium by means of the cooling second medium, the tank material thus needs good heat-conducting characteristics but also relatively good strength characteristics so that the tank can be made relatively thin-walled. Suitable such materials may be aluminum, copper, brass and magnesium. With advantage, the first tank is made integrally with protruding material portions. The first tank with said protruding material portions can thus be made as a single unit in a relatively simple way and at relatively low cost. The first tank may for example take the form of a unit made of aluminum by a die-casting process.

According to another preferred embodiment of the present invention, the cooler device comprises a second tank adapted to receiving the warm first medium after it has been cooled in the cooling portion. With advantage, the second tank is made of a plastic material. Making tanks of plastic material is particularly inexpensive. The second tank may be made of an injection-moulded plastic material. The cooler device with a second tank made of a plastic material will be relatively inexpensive to make.

According to a preferred embodiment of the present invention, the cooling portion comprises tubular elements made of aluminum. Aluminum is an advantageous material for making the tubular elements because it has very good heat-conducting characteristics, is of relatively low weight and is a relatively inexpensive material. With advantage, the cooling portion comprises a plurality of tubular elements arranged in parallel, each of which is adapted to leading the first medium between the first tank and a second tank. The cooling portion may comprise a relatively large number of such tubular elements arranged in substantially one plane at constant intervals and intended to guide the warm first cooling medium as it cools through the cooling portion.

According to a preferred embodiment of the present invention, said warm first medium is a liquid. It may be the radiator liquid in a cooling system whose function is to cool a combustion engine of a vehicle, or oil in an oil system. Alternatively, the warm first medium may be compressed air which is cooled in a cooler device in the form of a charge air cooler before it is led to a supercharged combustion engine. The cooling second medium is with advantage surrounding air. With suitable positioning of the cooler device, surrounding air can substantially always be used as cooling medium. The cooler device may be arranged at a front portion of a vehicle so that surrounding air flows through it.

BRIEF DESCRIPTION OF THE DRAWINGS

A preferred embodiment of the invention is described below by way of example with reference to the attached drawings, in which.

DETAILED DESCRIPTION OF PREFERRED EMBODIMENTS OF THE INVENTION

Figure 1:
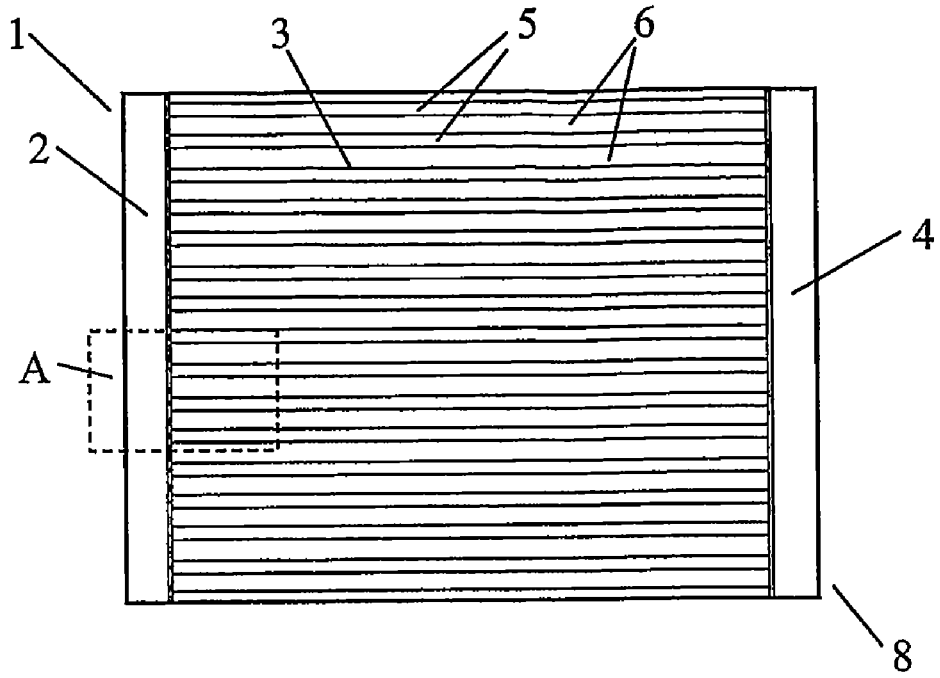
FIG. 1 depicts a cooler device according to the present invention.

FIG. 1 depicts a cooler device which may for example be fitted at a front portion of a vehicle. The function of the cooler device is to cool a radiator liquid which circulates in a cooling system. The cooling system may be intended to cool a combustion engine which is itself intended to power the vehicle. The combustion engine may be a diesel engine. The cooler device comprises an inlet 1 to a first tank 2 for receiving warm radiator liquid from the combustion engine. The warm radiator liquid is gathered in the first tank, from which it is led into a cooling package 3 which extends between the first tank 2 and a second tank 4. The cooling package 3 comprises a plurality of tubular elements 5 which extend between the first tank 2 and the second tank 4.

Figure 2:
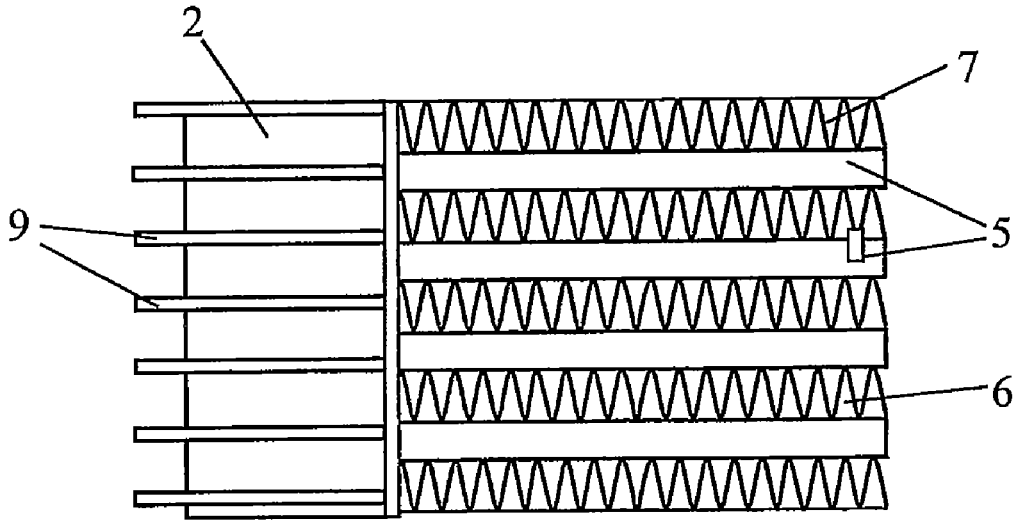
FIG. 2 depicts the region marked A of the cooler device in FIG. 1 in more detail and FIG. 3 depicts a sectional view of a first tank of the cooler device.

The tubular elements 5 are arranged in parallel at substantially equal distances from one another so that there are regular gaps 6 between adjacent tubular elements 5. This may be seen most clearly in FIG. 2, which depicts a region A close to the first tank 2 in more detail. Surrounding air is intended to flow through the gaps 6 between the tubular elements 5. The gaps 6 comprise thin folded metal elements 7. The thin folded metal elements 7 are arranged in contact with the tubular elements 5. The thin folded metal elements 7 thus increase the contact surface of the tubular elements 5 with surrounding air which flows through the passages 6. The flow of surrounding air through the cooling package 3 may be brought about by the vehicle's movement and/or by a radiator fan which draws air through the cooling package 3. The surrounding air cools the radiator liquid being led through tubular elements 5. The second tank 4 receives the cooled the radiator liquid from the respective tubular elements 5, after which the radiator liquid is led out from the second tank 4 via an outlet 8.

Surrounding air thus flows through the cooling package 3. An air flow which is not negligible in amount also takes place round the sides of the cooler device close to the tanks 2, 4. In order to utilise also this cooling air flow, the cooler device according to the present invention is provided with a first tank 2 which has protruding material portions 9. The protruding material portions 9 extend in an annular manner round the first tank 2 at substantially constant distances from one another. The protruding material portions 9 may however be of substantially any desired but functional shape. The first tank 2 thus provides a markedly increased contact surface with the air which flows past the first tank 2. The warm radiator liquid thus undergoes a not inconsiderable first step of cooling within the first tank 2 before it is led to the cooling portion in which it undergoes its main cooling in the tubular elements 5.

Figure 3:
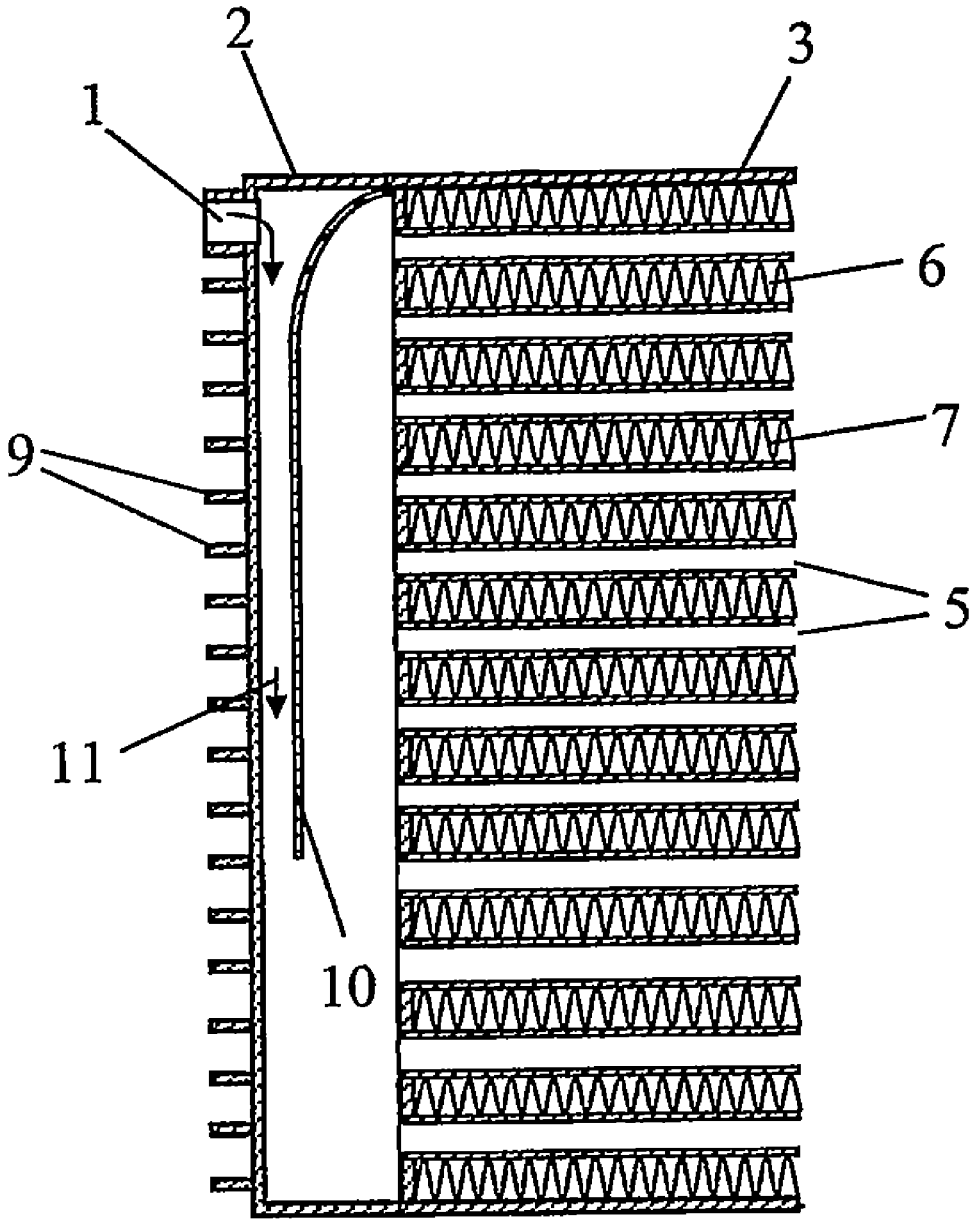

FIG. 3 depicts a section through the first tank 2. A flow element 10 is here arranged within the first tank 2. The shape and positioning of the flow element 10 are such that it leads the incoming radiator liquid from the inlet 1 substantially vertically downwards in the tank 2 along a flow path 11. The flow path 11 is defined by a surface of the flow element 10 and an inside surface of the tank 2 which is situated internally to an outside surface which is in contact with surrounding air. The flow element 10 has here an extent along large portions of the extent of the first tank 2 in the height direction. The warm radiator liquid flowing in the flow path 11 in contact with the inside surface of the first tank 2 is subjected to effective cooling by the surrounding air. When the radiator liquid leaves the flow path 11, it has undergone a first step of cooling. It is thereafter led into the tubular elements 5 in which it undergoes its main cooling. The flow element 10 may be of any desired but functional shape so that one or more flow ducts 11 with suitable dimensions are provided for cooling the radiator liquid. The flow element 10 may also comprise holes or the like for leading the radiator liquid from the flow path 11 to the cooling portion 3. The surface of the flow element 10 which defines the flow path 11 may be provided with a surface structure which promotes turbulent flow of the radiator liquid in the flow path 11.

To provide further cooling of the radiator liquid in the first tank 2, the latter is made of a material with good heat-conducting characteristics. Heat can thus be led away quickly and effectively from the warm radiator liquid which is in contact with the inside surface of the first tank 2 to an outside surface of the first tank 2 which is in contact with surrounding air. The first tank 2 also needs to be made of a material of relatively good strength. The walls of the tank 2 can thus be made rather thin, thereby further enhancing the possibility of heat transfer between the radiator liquid in the tank 2 and surrounding air. The first tank 2 is with advantage made of aluminum, which is a material with very good heat-conducting characteristics and relatively good strength characteristics. The first tank 2 with protruding material portions 9 may be made integrally of, for example, die-cast aluminum.

The tubular elements 5 of the cooling portion 3 are also made of a material with good heat-conducting characteristics. The tubular elements 5 may therefore with advantage be made of aluminum, like the thin folded metal elements 7. The cooling portion 3 is thus provided with very good cooling capacity when surrounding air flows through it. When the radiator liquid reaches the second tank 4, further cooling of the radiator liquid in the second tank 4 is not possible, owing to the relatively small temperature difference here between the radiator liquid and the surrounding air. There is therefore no reason to make the second tank 4 of a material with good heat-conducting characteristics. The second tank 4 is therefore made with advantage of a plastic material, which is most advantageous from the cost point of view.

During operation of the vehicle, warm radiator liquid is led from the combustion engine to the first tank 2, where it is subjected to a very good first step of cooling due to the protruding material portions 9, the internal flow element 10 and the tank material's good heat-conducting characteristics. The radiator liquid is thereafter led into the tubular elements 5, where it undergoes its main cooling. The cooler device according to the present invention thus provides a greater cooling effect than a conventional radiator of comparable size. The cooler device can thus cool the radiator liquid to a lower temperature than a conventional radiator of comparable size. Alternatively, the cooler device may replace a conventional radiator of comparable cooling capacity. In that case, cooler device may take the form of a smaller cooling portion 3 than the conventional radiator and therefore occupy less space.

The invention is in no way limited to the embodiments described with reference to the drawings but may be varied freely within the scopes of the claims. The cooler device may be a so-called charge air cooler which cools warm compressed air before it is led to a supercharged combustion engine. The cooler device may also form part of a cooling circuit for cooling an oil in an oil system. The cooling medium need not necessarily be surrounding air but may also be a liquid cooling medium which is circulated in a cooling system.

The invention claimed is:

1. A cooler device comprising a cooling portion including at least one tubular element, the tubular element having an internal flow duct with an entrance side and an exit side for guiding a first medium to be cooled, the tubular element having an outside surface, wherein a second cooling medium in contact with the outside surface of the tubular element cools the first medium as the first medium is led through the flow duct, and a first tank at the entrance side of the cooling portion and configured to receive the first medium before the first medium is led into the entrance side of the flow duct, wherein the first tank has an outside surface, protruding material portions on the outside surface of the first tank together with the outside surface producing an enlarged contact surface for contact with the cooling second medium, to subject the first medium to a first step of cooling within the first tank, the first tank having an inside surface situated close to the outside surface which is in contact with the cooling second medium; the first tank having an entrance for the first medium;

a flow element inside the first tank having such a shape and being positioned to lead the first medium, after the first medium enters the first tank through the entrance, along a flow path in the tank wherein the first medium is in contact with the inside surface of the first tank.

2. A cooler device according to claim 1, wherein the first tank and the protruding material portions are comprised of material with good heat-conducting characteristics.

3. A cooler device according to claim 2, wherein the first tank and the protruding material portions are comprised of aluminum.

4. A cooler device according to claim 2, wherein the first tank is made integrally.

5. A cooler device according to claim 1, further comprising a second tank at the exit side of the flow duct, the second tank being configured to receive the first medium after it has been led through the flow duct and cooled in the cooling portion.

6. A cooler device according to claim 5, wherein the second tank is comprised of a plastic material.

7. A cooler device according to claim 1, wherein the at least one tubular element of the cooling portion is comprised of aluminum.

8. A cooler device according to claim 5, wherein the cooling portion comprises a plurality of the tubular elements arranged in parallel, each tubular element being configured to lead the first medium between the first tank and the second tank.

* * * * *